United States Patent [19]

Wescott

[11] Patent Number: 4,979,649

[45] Date of Patent: Dec. 25, 1990

[54] CAULKING GUN EXTENDER

[75] Inventor: James Wescott, New York, N.Y.

[73] Assignee: Marilyn Lowney Keegan, New York, N.Y.

[21] Appl. No.: 407,352

[22] Filed: Sep. 14, 1989

[51] Int. Cl.[5] ..... B67D 5/64

[52] U.S. Cl. ..... 222/174; 222/325; 239/525

[58] Field of Search ..... 222/325, 326, 327, 386, 222/174, 389; 239/285, 578, 532, 525

[56] References Cited

U.S. PATENT DOCUMENTS 3,726,440 4/1973 Deeb ..... 222/174

4,809,885 3/1989 Hayashi et al. ..... 222/174

*Primary Examiner*—H. Grant Skaggs

*Assistant Examiner*—Kenneth Noland

*Attorney, Agent, or Firm*—Schweitzer & Cornman

[57] ABSTRACT

Extender apparatus for a caulking gun having an axially displaceable piston, a front face having an opening therein, and a trigger mechanism for incrementally advancing the piston along a predetermined longitudinal axis, the extender including: an elongated skeletal frame for supporting a cartridge of caulking compound; the frame having a planar rear wall having an opening therein and a planar front wall having an opening therein; an adapter for connecting the frame to the front face of the caulking gun; an adjustable pivot for adjusting the relationship of the frame to the front face of the gun; a flexible shaft mounting an auxiliary piston on its forwardmost end; a connector fixed to the rearmost end of the flexible shaft for connecting the piston of the gun in a manner whereby the flexible shaft may be advanced incrementally by the incremental movement of the gun piston; and whereby the auxiliary piston is adapted to extrude caulking compound from the cartridge.

4 Claims, 3 Drawing Sheets

CAULKING GUN EXTENDER

BACKGROUND AND SUMMARY OF THE PRESENT INVENTION

The caulking gun art is very well developed with caulking guns presently available in a variety of lengths. Typical caulking guns have a chamber for receiving a disposable cartridge of caulking compound, which chamber is attached to a trigger assembly which advances a piston into the cartridge to expel caulking compounds or other extrudable material from the nozzle of the cartridge. Examples of the types of caulking guns which are available in regular and extended lengths are shown in U.S. Pat. Nos. 3,512,684; 3,726,440; and 4,262,822. These prior art guns, are well suited for certain standard applications but they do not meet all of the needs of the art where caulking material is to be applied at very extended lengths and at difficult to apply angles such as "around corners".

Accordingly, it is to an improvements in existing guns which will overcome the shortcomings of the prior art that the present invention is directed. More specifically, the extender apparatus of the present invention enables standard caulking guns to be provided with greater length by the assembly of one or more of the new and improved extenders to the front faces of existing caulking guns. In addition the new and improved extender apparatus allows the forwardmost end of the gun to be cocked, canted, or otherwise disposed at an angle to the central longitudinal axis of symmetry of the conventional gun to caulk at angles and around corners.

In accordance with the principles of the present invention, these and other objects and advantages of the present invention may be obtained by assembling the new caulking gun extender, through a selectively hingeable connection, to the front end of a conventional caulking gun by a special bracket and providing the extender with a flexible piston shaft. The bracket may be adjusted to hold the extender either co-axially with the central piston axis of the gun or in a desired angular relation with regard to the body of the gun. The new and improved extender has a clamping mechanism for attaching a unique, flexible piston shaft to the forwardmost end of the existing gun piston. In accordance with the principles of the present invention, the flexible piston shaft of the caulking gun extender is comprised of a series of articulated rod links, which enable caulking pressure to be applied by the main piston of the caulking gun to the extended flexible piston of the extender at an angle from the longitudinal axis of the gun piston shaft. This enables the gun effectively to be "bent" and caulking compound to be delivered "around corners" which would otherwise be inaccessible to "straight" extended or elongated caulking guns.

For a more complete understanding of the principles of the present invention and a better appreciation of the attendant advantages of its use, reference should be made to the following detailed description taken in conjunction with the accompanying drawings.

DETAILED DESCRIPTION OF THE INVENTION

Figure 1:
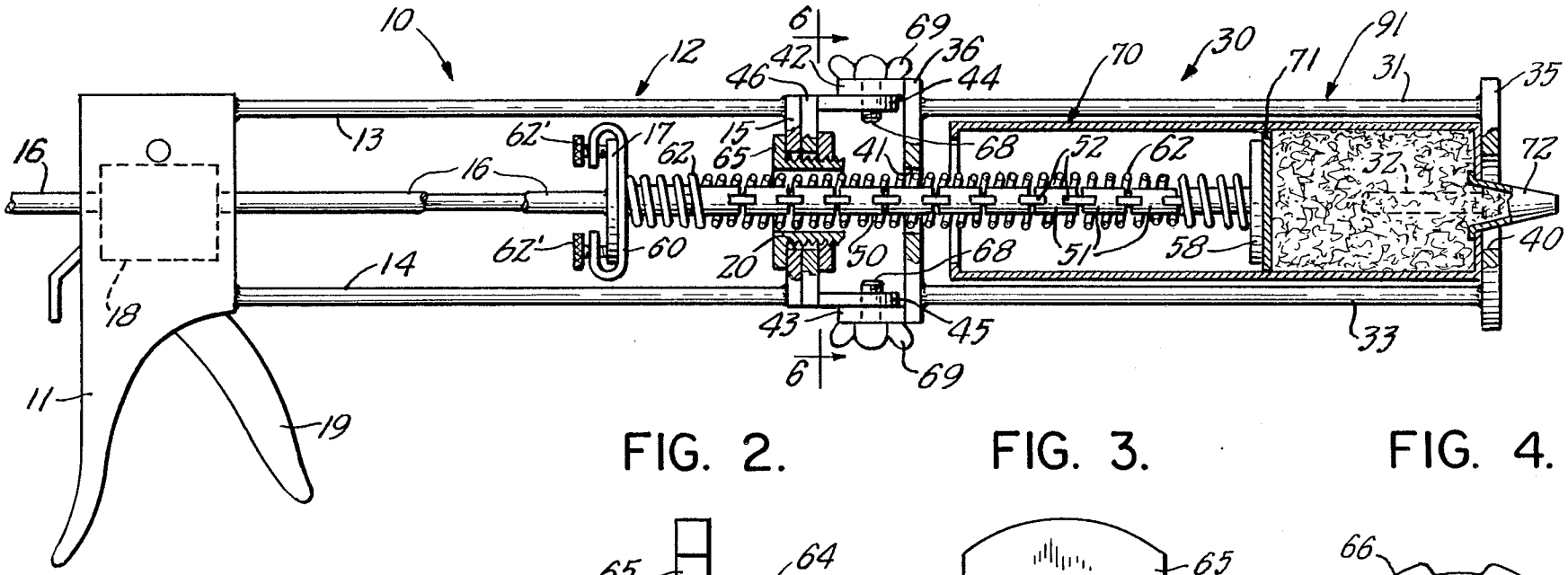
FIG. 1 is a top elevational view of a conventional caulking gun having a new and improved extender mounted thereon with parts broken-away to show the details of the construction.

Referring now to FIG. 1, the caulking gun extender 30 of the present invention is intended for use with a conventional caulking gun body 10, including a handle 11, and a skeletal cartridge holding frame 12 comprising elongated bars 13, 14 connected to the handle 11 and extending forwardly to a circular front plate 15 generally closing off the caulking gun 10. As is conventional in caulking guns of this type, there is an elongated piston rod or shaft 16 having a circular, disc-like piston head 17 affixed to its forward end which piston rod 16 may be advanced incrementally through the gun and into engagement with an inserted cartridge 70 by an appropriate ratchet or other incremental advancing mechanism 18, the details of which are not shown. The cartridge 70 is of a standard disposable construction having a cylindrical tubular body with a nozzle 72 at its front and a displaceable piston wall 71 fitted within the rearward portions. The incremental advancing mechanism 18 is actuated by a trigger 19, each squeeze of which advances the piston rod 16 an incremental step to force the cartridge wall 71 forward and to extrude caulking compound through the nozzle 72. An exemplary ratchet mechanism which may be employed to incrementally advance the piston rod 16 is shown in U.S. Pat. No. 3,512,684, the details of which ratchet mechanism are incorporated by reference herein. Alternatively, the ratchet mechanism shown in U.S. Pat. No. 3,726,440 may be employed in the gun 10 and the details of that ratchet mechanism are also deemed to be incorporated by reference herein.

The front face of the plate 15 has an opening 20 therein which permits the nozzle 72 of the caulking cartridge 70 to project outwardly when such a cartridge is mounted within the frame 12. Thus, when the gun 10 without the extender 30 of the invention, is normally used, the cylindrical cartridge 70 of caulking compound or other mastic material may be inserted in the frame with the piston 17 engaging the rearmost piston wall 71 of the cylindrical caulking cartridge 70. Upon squeezing of the trigger 19, the piston 17 will be incrementally advanced to force the piston into the cartridge 70 and to force caulking compound through the nozzle 72 and through the front of the gun to the desired point of application.

In accordance with the principles of the invention, the new and improved extender 30 may be incorporated into a standard caulking gun 10 to extend the length of the caulking gun and to adapt it for use in applying caulking compounds to a desired site of application remotely of an angle to the central axis symmetry of the caulking gun, e.g., "around corners".

Figure 2:
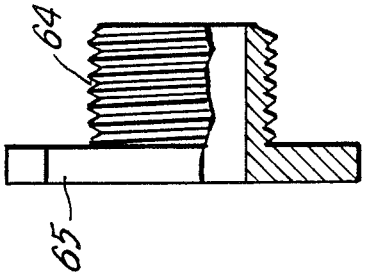
FIG. 2 Is a side view of a connector plate and threaded nipple.
Figure 3:
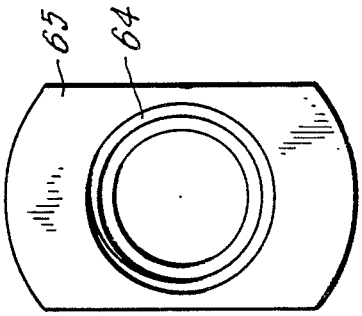
FIG. 3 Is a front view of the plate and nipple of FIG. 2.

Referring now to FIG. 2, the extender 30 of the present invention, generally includes a cartridge housing or frame 91 that is skeletal in form and is established by three elongated rods or bars 31, 32, and 33 which are screwed, welded, or otherwise fastened to a front wall plate 35 and a rear hinge plate member 36. The front wall plate 35 has an opening 40 formed therein through which the nozzle 72 of the caulking cartridge may project as will be understood; similarly, the hinge plate 36 has a circular opening 41 therein to permit a special linked flexible shaft 50 to extend therethrough. A pair of flanges 42, 43 project rearwardly from the plate 36 and are adapted to be hingedly connected to mating flanges 44, 45 which project forwardly from an adapter plate 46 which is mounted to the front face 15 of the caulking gun 10.

As will be appreciated, the extender 30 extends the effective working length of the gun. It enables a cartridge 70 to be mounted forwardly of the front face plate 15 of the conventional gun 10 thereby extending its effective length. As will be understood, if an extra-long gun extension is required, one or more intermediate extenders 30 may be employed to provide the gun with sufficient length.

Figure 4:
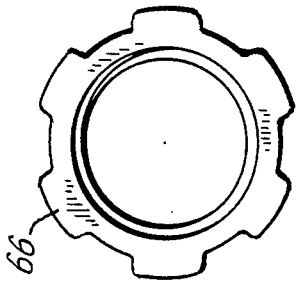
FIG. 4 Is a front view of a lock nut.
Figure 6:
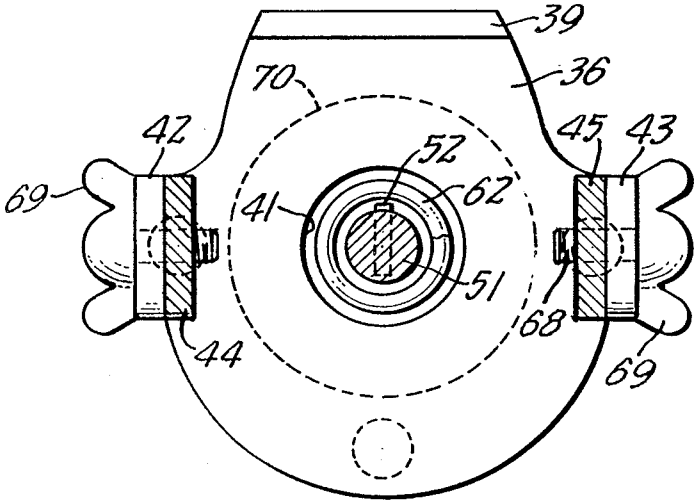
FIG. 6 Is a view of a hinge plate taken on the line 6—6 of FIG. 1.
Figure 5:
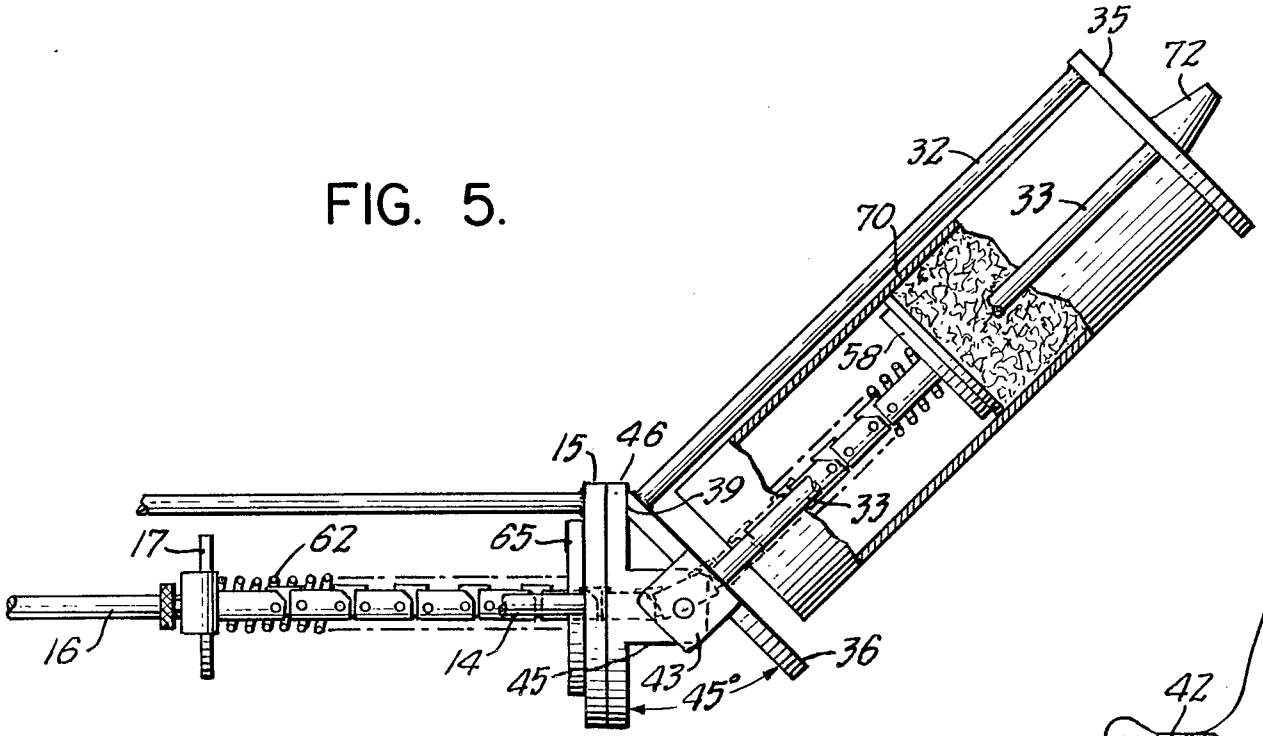
FIG. 5 Is a fragmentary side elevational view of the gun of FIG. 1 with the extender set at an angle with respect to the axis of the gun.
Figure 7:
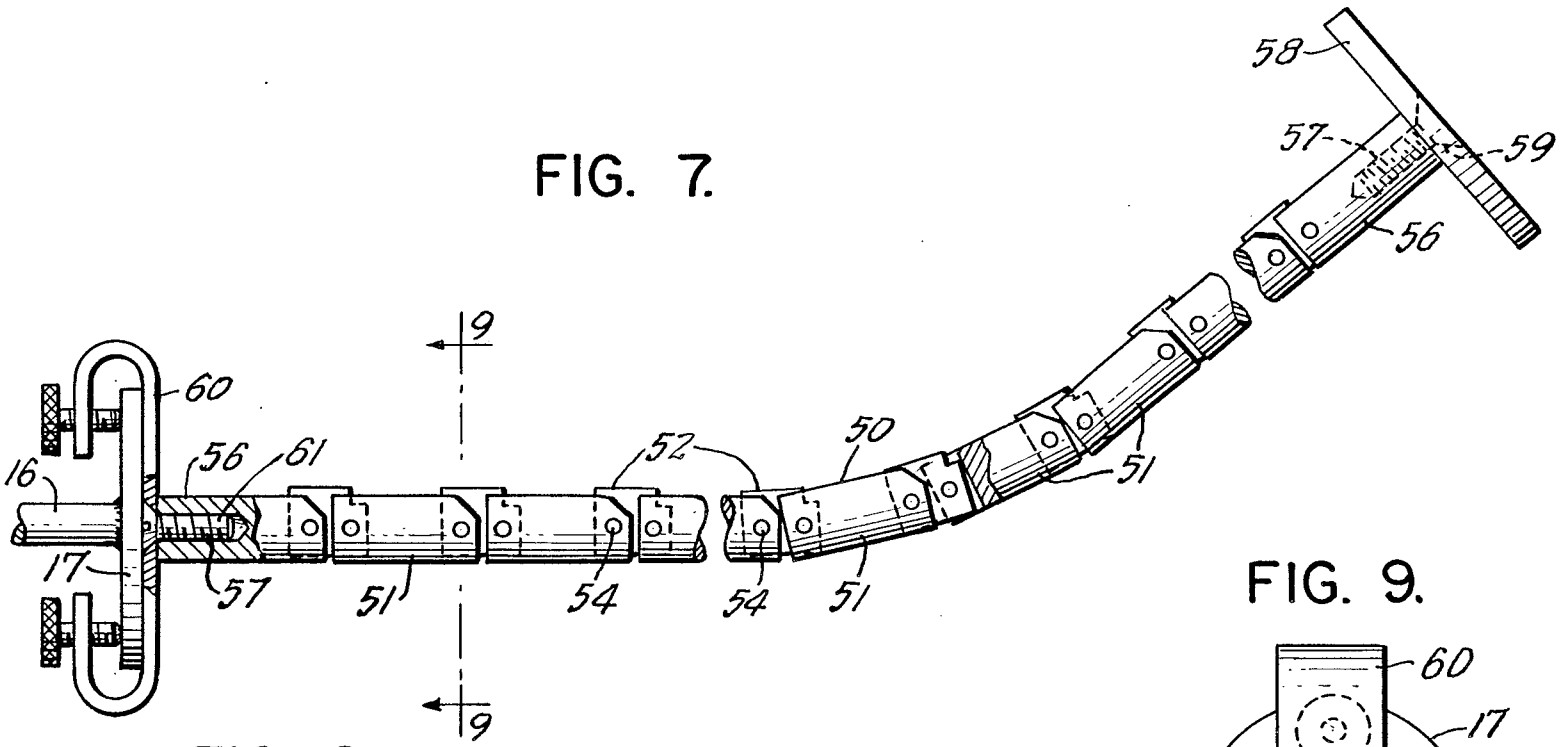
FIG. 7 Is a side elevational view of the flexible link shaft.
Figure 9:
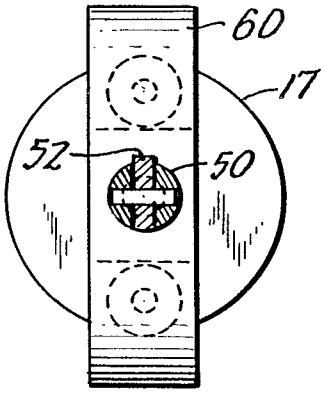
FIG. 9 Is a section view of the flexible link shaft taken on the line 9—9 of FIG. 7.
Figure 8:
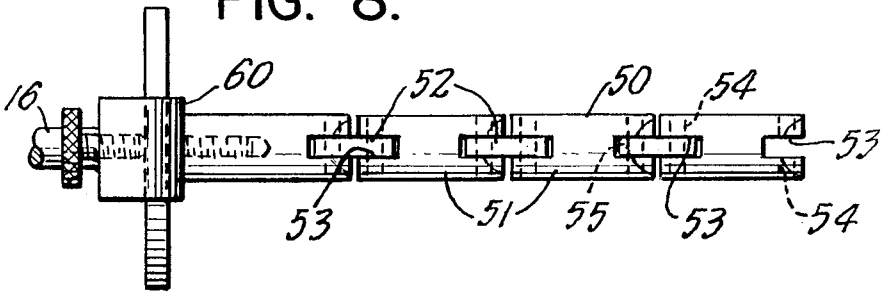
FIG. 8 Is a top elevational view of a section of the flexible link shaft.

In accordance with the principles of the present invention, the flexible linked shaft 50 is used to extrude in a piston-like fashion and at whatever angle the frame 31 is disposed, the caulking compound from the cartridge 70 mounted in the extender 30. The linked shaft 50 is shown in FIG. 4 and comprises a series of discrete cylindrical shaft link elements 51, which are articulated one to another for limited bending motion by flat hinge links 52 which are used to connect adjacent shaft link elements 51 in the manner shown in FIG. 4. Each of the shaft link elements 51 is fabricated from cylindrical rod stock and is provided with a slot 53 at its opposite ends into which the flat hinge link 51 may be inserted. Each of the shaft link elements 51 is pinned by rivets (not shown) or the like through shaft link holes 54 and comparable link hinge holes 55 formed in each of the hinge links 52. At its ends the link shaft 50 is provided with end links 56 having threaded bores 57.

The head end link 57 is adapted to mount a piston plate 58 by means of a screw 59 while the rearmost end link 56 is adapted to mount a U-shaped connecting bracket 60 by means of a screw 61. Before the end plate 58 and the U-shaped bracket 60 are fastened to the link shaft 50, a closely coiled flexible spring 62 is placed over the shaft to provide rigidity and constraint to the articulated shaft 50 and maintain the link shaft in a normally straight configuration. Thus, in accordance with the principles of the present invention, when the mounting hinge plate 36 is disposed at an angle to the adapter plate 46, thereby canting the extender frame 91 with respect to the axis of the gun 10, the link shaft 50 bends as it passes from the caulking gun 10 into the extender 30 to apply extruding pressure to the cartridge 70 in the extender 30 as will be understood.

More specifically, the linked shaft 50 is connected to piston 17 of the conventional gun by means of the U-shaped bracket 60 which is adapted to slide over the piston 17 and to be connected thereto by two set screws 62, as is shown in FIG. 1.

The adapter plate 46 is mounted to the front face of the gun 15 by means of a connector assembly comprising a connector nipple 64 which is formed integrally with a connector plate 65 which is disposed against the inner surfaces of the front plate 15 so that the nipple 64 projects forwardly as shown in FIG. 1. A lock nut 66 is threaded over the nipple 64 after the adapter plate 46 has been placed on the front face of the gun 10 in a manner whereby the adapter plate may be firmly secured to the front of the gun by the tightening of the lock nut 66 on the threaded nipple 64 as shown in FIG. 1.

The hinge plate 36 is connected to the adapter plate 46 through hinge bolts 68 and wing nuts 69. The angular relationship of the extender 30 to the caulking gun 10 may be adjusted by pivoting the extender 30 to a desired angle and then tightening the wing nuts 69 to adjust the angle of the extender to the caulking gun. At its upper edge, the hinge plate 36 is provided with a 45 degree bevel 39 as indicated in FIG. 2. The 45 degree beveled edge 39 is adapted to abut the front face of the adaptor plate 46 to limit, to brace, and to rigidify the caulking gun extender 30 when it is rotated to the predetermined 45 degree angle. Of course, if a lesser angle is required it may be selectively set by pivoting the extender through bolts 68 and thereafter tightening the wing nuts 69 to lock the extender 30 in its desired adjusted angular position.

While the present caulking gun extender invention has been described with a reference to a preferred embodiment, it should be understood that certain variations will be apparent to those skilled in the art without departing from the clear scope of the invention as defined hereinafter in the appended claims.

I claim:

1. Extender apparatus a for caulking gun having an axially displaceable piston, a front face having an opening therein, and a trigger mechanism for incrementally advancing said piston along a predetermined longitudinal axis, said extender including:

(a) an elongated skeletal frame means for supporting a cartridge of caulking compound;

(b) said frame means having a planar rear wall having an opening therein and a planar front wall having an opening therein;

(c) said rear wall includes rearwardly projecting first flanges, (d) adapter means for connecting said frame means to the front face of said caulking gun;

(e) said adapter means includes second flanges projecting forwardly in juxtaposition with said first flanges, and (f) adjustable pivot means for adjusting the relationship of said frame means to said front face of said gun;

(g) a flexible shaft means mounting an auxiliary piston on its forwardmost end;

(h) a connector means fixed to the of rearmost end of said flexible shaft for connecting the piston of said gun in a manner whereby said flexible shaft may be advanced incrementally by the incremental movement of said gun piston;

(i) locking wing nut means extend through said first and second flanges to accommodate selective pivotal movements of said frame with respect to said gun.

2. Extender apparatus in accordance with claim 1 further characterized, in that:

(a) said flexible shaft comprises a series of rigid links articulated by interposed hinge elements; and (b) a coil spring encases said articulated links.

3. The extender apparatus of claim 1 further characterized, in that:

(a) said connector means is a U-shaped bracket having set screws for locking said gun piston to said flexible shaft.

4. The extender apparatus of claim 1 further characterized, in that:

(a) the rear wall of said frame means includes a beveled edge to limit to a predetermined angle the pivoting movement of said frame with respect to said front gun face.

* * * * *